US006931678B2

(12) United States Patent
Boyd

(10) Patent No.: US 6,931,678 B2
(45) Date of Patent: Aug. 23, 2005

(54) WATER-SWUNG HAMMOCK

(76) Inventor: Peter Dunbar Boyd, 128 Danbury La., Redwood City, CA (US) 94061

( * ) Notice: Subject to any disclaimer, the term of this patent is extended or adjusted under 35 U.S.C. 154(b) by 0 days.

(21) Appl. No.: 10/464,355

(22) Filed: Jun. 17, 2003

(65) Prior Publication Data

US 2004/0049848 A1 Mar. 18, 2004

Related U.S. Application Data

(60) Provisional application No. 60/389,285, filed on Jun. 18, 2002.

(51) Int. Cl.[7] ..... B63C 9/08; A45F 3/22

(52) U.S. Cl. ..... 5/120; 5/122; 5/123; 5/127; 441/129; 441/130

(58) Field of Search ..... 114/345, 363; 441/43, 129–132; 5/120, 122, 123, 127

(56) References Cited

U.S. PATENT DOCUMENTS 689,020 A * 12/1901 Pruden ..... 441/80
744,590 A * 11/1903 Moore ..... 114/39.28
1,349,897 A * 8/1920 McDonah ..... 441/43
2,396,148 A * 3/1946 Bean ..... 441/45
2,974,331 A * 3/1961 Dize ..... 441/130
4,828,517 A * 5/1989 van Liefland ..... 440/27
5,290,196 A * 3/1994 Steel ..... 441/130
5,518,431 A * 5/1996 Staley ..... 441/130
5,711,240 A * 1/1998 Baker ..... 114/61.25
5,729,845 A * 3/1998 Hsu ..... 5/120
6,467,109 B1 * 10/2002 Wu ..... 5/120

* cited by examiner

*Primary Examiner*—Michael Trettel
(74) *Attorney, Agent, or Firm*—Dykema Gossett PLLC

(57) ABSTRACT

A water-swung hammock includes a floatable body for supporting a main body frame including at least one leg support for securing the main body frame to the floatable body. A staging platform may be coupled to the main body frame and capable of supporting a user. A swingable sheet may be provided for supporting the user and includes a support for swingable suspension of the swingable sheet relative to the main body frame. A water-swinging pendular assembly may be coupled to the main body frame for receiving water movement and thereby imparting motive power to the swingable sheet of the water-swung hammock.

20 Claims, 6 Drawing Sheets

WATER-SWUNG HAMMOCK

CROSS-REFERENCE TO RELATED APPLICATIONS

This application claims the benefit of U.S. Provisional patent application No. 60/389,285 filed Jun. 18, 2002.

BACKGROUND OF THE INVENTION a. Field of Invention

The present invention relates to the field of body supporting structures, and more particularly to a water-swung hammock for use on lakes, oceans and other water environments.

b. Description of Related Art

Hammock existence has been documented for roughly one thousand years with an estimated number of present day users at 100 million worldwide. The structure of a hammnock is defined as a swingable sheet of material suspended between two attachment points adapted to support a user for the purpose of swinging and relaxation. However, to swing back and forth in a hammock one must employ a measure of human or mechanical effort for motive power.

The present invention provides an apparatus that requires no measure of human or mechanical effort to swing back and forth, adding a new dimension of water responsiveness to a hammock thereby enhancing a hammock's relaxation characteristics to greatly increase the enjoyment obtained therefrom.

As discovered with the first prototype, which can be viewed by logging onto www.waterhammocks.com, a water-swung hammock operates best with a sufficient amount of floatation means to stabilize the frame, while at the same time having a floatation means to provide a measure of impact absorption to achieve stabilization in more active waters.

In U.S. Pat. No. D 370,956 issued Jun. 18, 1996 a water hammock is presented as a sheet immersed in water.

In U.S. Pat. No. 5,186,667 issued Feb. 16, 1993 a floating hammock is presented as a floating article immersed in water.

These disclosures operate outside the fundamental characteristics of a free-swinging sheet known to define a hammock, likewise, they do not operate on water as aquatic hammocks or on-land as hammocks, nor are they interchangeable with other brands of hammocks, improve upon a hammock, or expand upon the existing hammock market.

A water-swung hammock can be used on-land if desired, is interchangeable with other brands of hammocks, improves upon a hammock and thereby expands upon the existing hammock market while at the same time defining a new class of hammocks.

While personal floatation devices, floating articles and inflatable mattresses as in the aforementioned patents present interest in the hammock market, these floatation means are configured for use in a specific manner and do not relate to the present invention in any way.

OBJECTS AND ADVANTAGES

Therefore, one main objective of the present invention is to provide a water-swung hammock that floats on a body of water.

It is a further object of the present invention to provide a water-swung hammock that swings by the natural movement of water.

It is a further object of the invention to provide a fully integrated, simple to use, easily assembled, reliable water-swung hammock capable of being carried and stored easily, and of being used in a variety of ways for relaxation, diving off and storage of items, and having effective, efficient, and reliable means for the attachment of components and auxiliary equipment.

Attachment of components and auxiliary equipment may include without limitation, adaptable shade canopies, gas or electric powered engines, sails or kites, utility compartment/s, secured attachments for towing and tying off, straps for towing and tying off, a ladder, an anchor and line, a pillow rest, a cushioned swingable sheet, a cushioned staging platform, non-slip decking for a staging platform, foot straps for a staging platform, removable staging platform, interchangeable hammocks with or without spreader bars, smaller water-swung hammocks for juniors, single seated water-swung hammocks or larger sized water-swung hammocks for more lounging space, frame members to permit shortening and lengthening of length and width main body frame and supports, anti-roll lines for a swingable sheet, additional floatation, a pulley system to lower a water-swung hammock without a staging platform into the water for cooling off, climbing off, climbing on and raising the hammock.

It is a further object of the invention to provide such a system in an affordable, cost-effective form.

It is a further object of the invention to provide such a system in an easily dismantled, easily stored and transportable form.

It is a further object of the invention to provide such a system with effective, efficient and reliable attachments for components and auxiliary equipment, which are neither too flexible nor too inflexible.

It is a further object of the invention to provide a detachable frame for a water-swung hammock which is durable, effective, efficient and may be quickly, easily, and reliably assembled or broken down for storage.

It is a further object of the invention to provide a swingable sheet for a detachable frame for a water-swung hammock which is durable, effective, efficient and may be quickly, easily, and reliably assembled or broken down for storage.

It is a further object of the invention to provide a staging platform of non-skid material for a detachable frame for a water-swung hammock which are durable, effective, efficient and may be quickly, easily, and reliably assembled or broken down for storage.

It is a further object of the invention to provide leg supports for a detachable frame for a water-swung-hammock which are durable, effective, efficient and may be quickly, easily, and reliably assembled or broken down for storage.

It is a further object of the invention to provide inflatable supports for a water-swung hammock which are durable, effective, efficient and may be quickly, easily, and reliably assembled or broken down for storage.

It is a further object of the invention to provide floatable supports attachments, staging platform attachments, leg support attachments, frame support attachments, swingable suspension attachments, water-swingable attachments and swingable sheet attachments for a water-swung hammock which are durable, effective, efficient and may be quickly, easily, and reliably assembled or broken down for storage.

It is a further object of the invention to provide a water-swung hammock and components for a water-swung hammock, which can be assembled and dismantled quickly, with a minimum of tools, or without any tools.

It is a further object of the invention to provide a water-swung hammock which can be used or adapted for a variety of purposes, including but not limited to: a swimming platform, a flotation device, a tow-float, or a "boat" or "water" trailer for transporting equipment or supplies.

It is a further object of the invention to provide floatable supports, leg supports, frame supports and staging platform and swingable sheet of a water-swung hammock of sufficient width or beam to allow stable operation.

It is another object of the present invention to provide a water-swung hammock for use in cold and hot, rough and calm weather environments.

It is another object of the present invention to provide a water-swung hammock adapted for use on-land.

It is another object of the present invention to provide a water-swung hammock for staying dry and optionally as a platform for getting wet.

These and such other objects of the invention as will become evident from the disclosure below are met by the invention disclosed herein.

SUMMARY OF INVENTION

The present invention achieves the aforementioned exemplary objects by providing a water-swung hammock being an aquatic relaxation apparatus and including a floatable body adapted to support a main body frame including leg supports adapted to secure the main body frame to the floatable body. The hammock may further include a staging platform including means for attachment to the main body frame adapted to support a user, and a swingable sheet having means for attachment to the main body frame adapted to support a user and water-swinging pendular assembly associated to the main body frame adapted to receive water movement for motive power for the water-swung hammock. The floatable body may include a plurality of hollow support members having an inner periphery and an outer periphery. The outer periphery may include attachment members, and the inner periphery may define a space therewithin. The outer periphery may further include an air valve for inflating the hollow support members with air needed to float the present invention on a body of water. The main body frame may include a plurality of elongated members, formed members and extension members joined at spaced locations for unifying the main body frame. The main body frame may include means for attachment extending from opposite ends of the main body frame to receive the waterswinging pendular assembly. The leg supports may include a plurality of elongated members attached generally perpendicular to outer portions of the main body frame. The elongated members may be positioned laterally on the outer periphery of the hollow support members and latched to attachment members. The swingable sheet may include a body supporting portion for receiving a pair of rigid elongated members at opposite ends, the elongated members being adjustably attachable with corners of the body supporting portion to sustain an open shape. The elongated members may be attachable to swingably suspend outer most points of the swingable sheet. The water-swinging pendular assembly may include a pair of adjustable cords having attached at opposite ends, with first ends detachably engaged at opposite ends of the main body frame, and second ends secured to opposite ends of the swingable suspension. The staging platform may include a plurality of body supporting panels secured generally perpendicular to mid-section of the main body frame.

The present invention therefore provides a water-swung hammock including a floatable body for supporting a main body frame including at least one leg support for securing the main body frame to the floatable body, and a staging platform being coupled to the main body frame and capable of supporting a user. The water-swung hammock may further include a swingable sheet for supporting the user and including a support for swingable suspension of the swingable sheet relative to the main body frame, and a water-swinging pendular assembly coupled to the main body frame for receiving water movement and thereby imparting motive power to the swingable sheet of the water-swung hammock.

For the water-swung hammock described above, the floatable body may include at least one hollow support member having an inner periphery and an outer periphery. The outer periphery may include attachment members for attachment of the main body frame to the floatable body. The inner periphery may include a space therewithin. The floatable body may further include an inflation assembly for inflating the hollow support member for thereby enabling floatation of the water-swung hammock on a body of water. The main body frame may include a plurality of elongated members, formed members and extension members, the formed members coupling the elongated and extension members to form the main body frame. The leg support may include a plurality of elongated members attached to the main body frame. The elongated members may be positioned laterally on the outer periphery of the hollow support members and latched to the attachment members. The swingable sheet may be coupled to a pair of rigid elongated members at respective opposite ends thereof. The elongated members may be adjustably attachable with the swingable sheet to maintain the swingable sheet in an open shape. The water-swinging pendular assembly may include a pair of adjustable cords attachable at first ends thereof to the main body frame and at second ends thereof to the swingable sheet. The staging platform may include a plurality of body supporting panels and may be secured generally perpendicular to a mid-section of the main body frame. The main body frame may be formed of a one-piece structure. The floatable body may include at least one support member enabling floatation of the water-swung hammock on a body of water.

The invention yet further provides a water-swung hammock including a floatable body for supporting a main body frame including a support for securing the main body frame to the floatable body, and a staging platform coupled to the main body frame. The water-swung hammock may further include a swingable sheet for supporting a user, the swingable sheet being pivotally suspended relative to the main body frame, and a pendular assembly coupled to the main body frame and the swingable sheet for receiving water movement and thereby imparting motive power to the swingable sheet.

For the water-swung hammock described above, the floatable body may include at least one hollow support member having an inner periphery and an outer periphery. The outer periphery may include attachment members for attachment of the main body frame to the floatable body. The inner periphery may include a space therewithin. The floatable body may further include an inflation assembly for inflating the hollow support member for thereby enabling floatation of the water-swung hammock on a body of water. The main body frame may include a plurality of elongated members, formed members and extension members, the formed members coupling the elongated and extension members to form the main body frame. The main body frame may be formed of a one-piece structure. The support may include a plurality of elongated members attached to the main body frame. The elongated members may be positioned laterally on the outer periphery of the hollow support members and latched to the attachment members. The swingable sheet may be coupled to a pair of rigid elongated members at respective opposite ends thereof. The elongated members may be adjustably attachable with the swingable sheet to maintain the swingable sheet in an open shape. The pendular assembly may include at least one adjustable cord attachable at a first end thereof to the main body frame and at a second end thereof to the swingable sheet. The staging platform may include a plurality of body supporting panels and may be secured generally perpendicular to a mid-section of the main body frame. The water-swung hammock may further include a seating area shaped by opposing spreader bars.

The invention yet further provides a water-swung hammock including a floatable body for supporting a main body frame, a staging platform coupled to the main body frame, a swingable sheet for supporting a user, the swingable sheet being pivotally suspended relative to the main body frame, and a pendular assembly coupled to the main body frame and the swingable sheet for receiving water movement and thereby imparting motive power to the swingable sheet. Alternatively, the invention yet further provides a water-swung hammock including a floatable body including a main body frame, a swingable sheet for supporting a user, the swingable sheet being pivotally suspended relative to the main body frame, and a pendular assembly coupled to the main body frame and the swingable sheet for receiving water movement and thereby imparting motive power to the swingable sheet.

For the water-swung hammock described above, the floatable body includes a circular, rectangular or oval cross-section. The main body frame may be coupled to the floatable body, or alternatively, the main body frame may be integrally formed with the floatable body.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION-PREFERRED EMBODIMENTS

Figure 1:
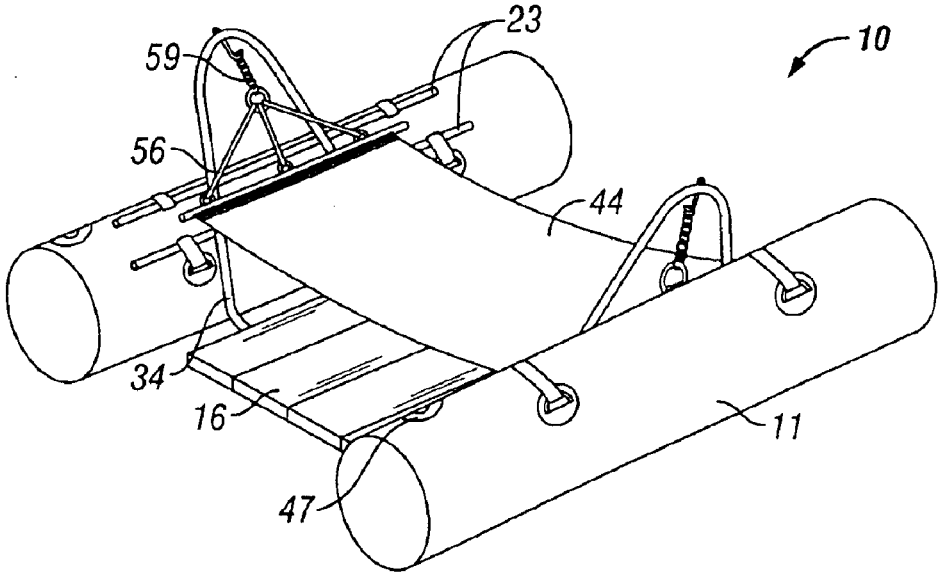
FIG. 1 is a perspective view of a water-swung hammock according to the present invention including the floatable bodies.
Figure 2:
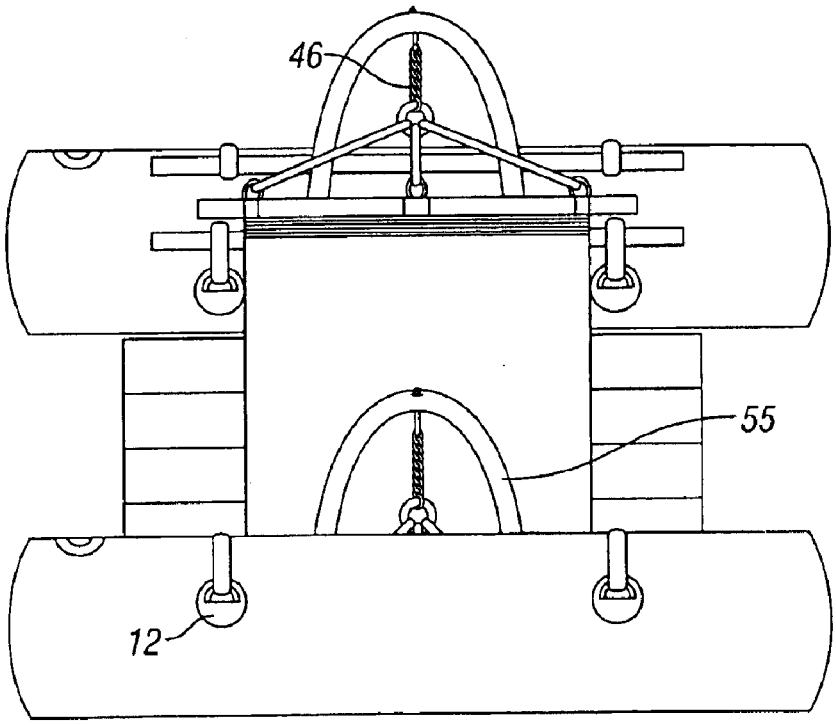
FIG. 2 is an elevated view of the water-swung hammock of FIG. 1, including the floatable bodies.

Referring now to the drawings wherein like reference numerals designate like and corresponding parts throughout the several views, FIGS. 1–10 illustrate a water-swung hammock according to the present invention, generally designated 10.

Figure 4:
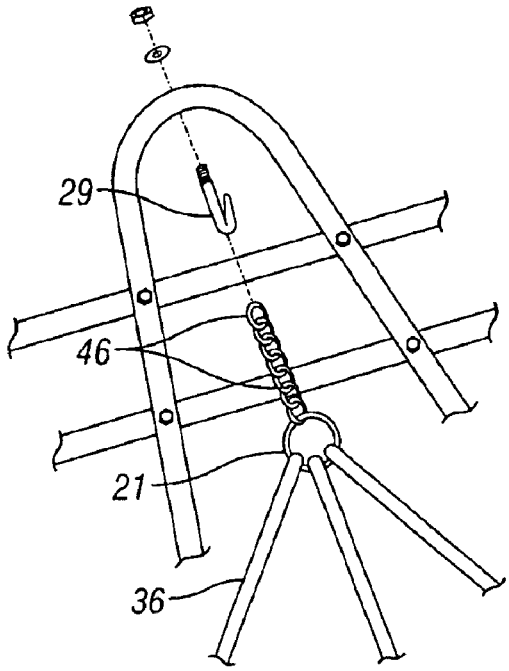

As shown in FIG. 1, water-swung hammock 10 may generally include floatable body 11 adapted to support a main body frame 34 including leg supports 23 adapted to secure main body frame 34 to floatable body 11. A staging platform 16 may include brackets 30 or other known means for attachment of staging platform 16 to main body frame 34 for supporting a user. Water-swung hammock 10 may further include a swingable sheet 44 coupled to main body frame 34 for supporting a user and water-swinging pendular assembly 59 associated to main body frame 34 and adapted to receive water movement for imparting motive power to swingable sheet 44 of water-swung hammock 10. As shown in FIGS. 1 and 4, swingable sheet 44 may be coupled to hook 29 by means of a chain or another such assembly 46 and ring 21 having extensions 36 of swingable suspension 56 coupled thereto.

Referring to FIG. 1, floatable body 11 may include a plurality of hollow support members having an inner periphery and an outer periphery. The outer periphery of the support members may include attachment members 12, and the inner periphery of the support members may define a hollow space therewithin. Floatable body 11 may further include air valves 47 or the like for inflating the hollow support members with air needed to float hammock 10 on a body of water.

Figure 9:
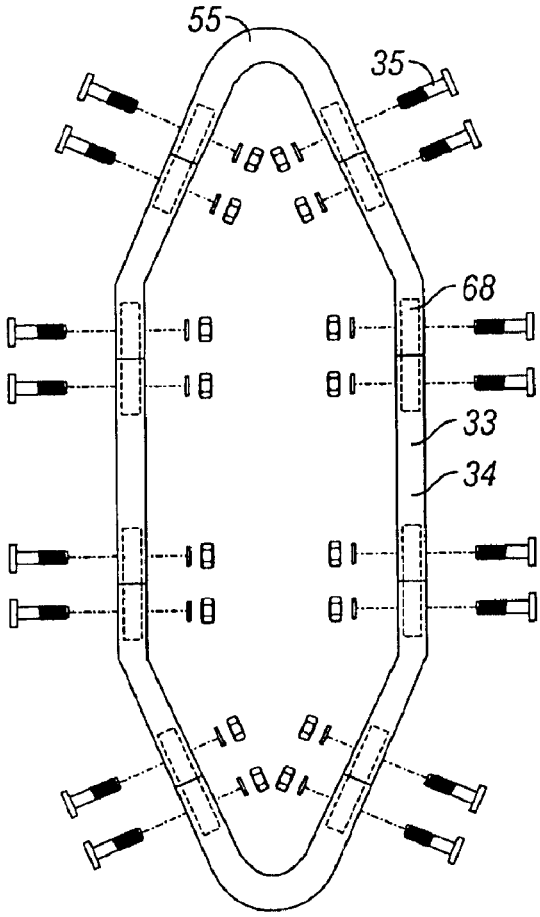
FIG. 9 is a fragmented view of the water-swung hammock of FIG. 1, including main body frame, extension members, spaced joint locations and means for attachment of the main body frame.
Figure 10:
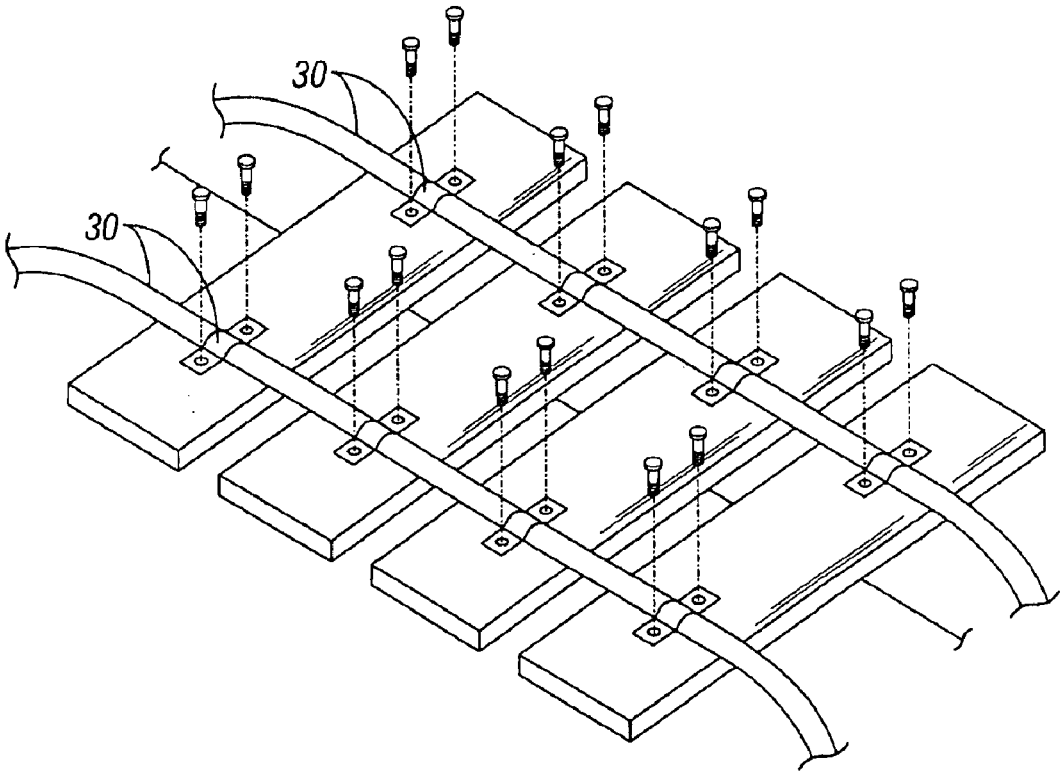
FIG. 10 is a fragmented view of the water-swung hammock of FIG. 1, including a mid-section of a main body frame, staging platform panels and means for attachment of same.

As shown in FIG. 9, main body frame 34 may include a plurality of elongated members 55, formed members 68 and extension members 33 conjoined together to form main body frame 34. Members 55, 68 and 34 may be joined together by nut/bolt fasteners 35 or other means known in the art. As briefly discussed above and as shown in FIG. 1, main body frame 34 may further include hooks 29 or the like extending from opposite ends thereof for receiving water-swinging pendular assembly 59 and thereby attaching swingable sheet 44 to frame 34.

Figure 3:
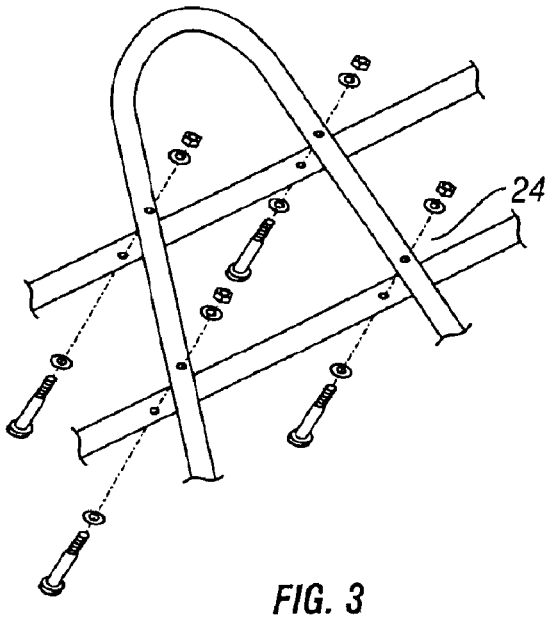
FIGS. 3 and 4 is a fragmented view of the water-swung hammock of FIG. 1, including end portions of main body frame and leg supports.

Referring to FIGS. 1 and 3, leg supports 23 may include a plurality of elongated members attached to outer portions of main body frame 34 by means of nut/bolt fasteners 24 or other known means. The elongated members may be positioned laterally on the outer periphery of the hollow support members and latched to attachment members 12.

Figure 5:
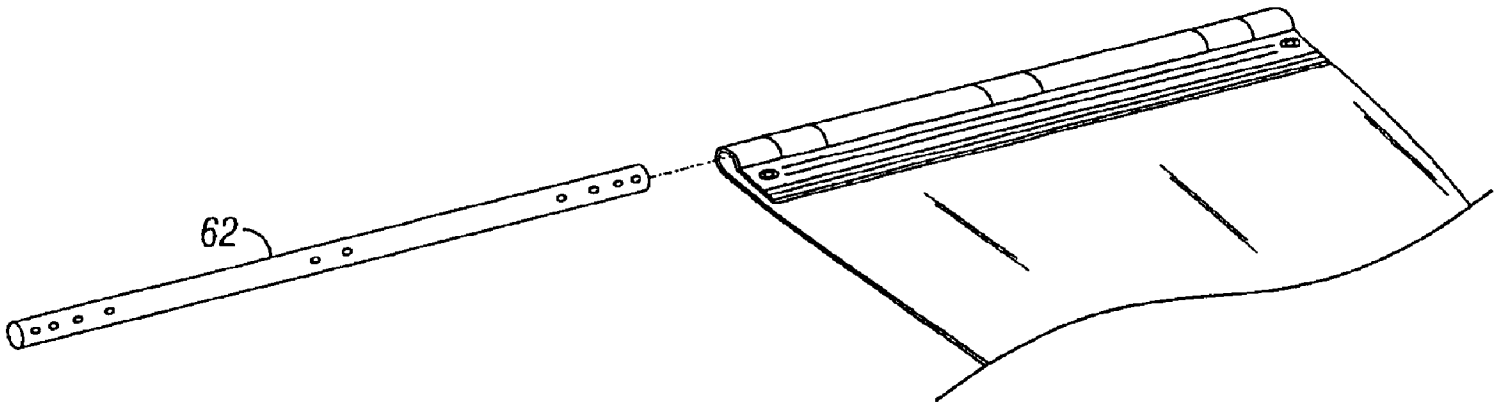
FIG. 5 is a fragmented view of the water-swung hammock of FIG. 1, including a rigid elongated member and means for receiving the member into end portions of swingable sheet.
Figure 6:
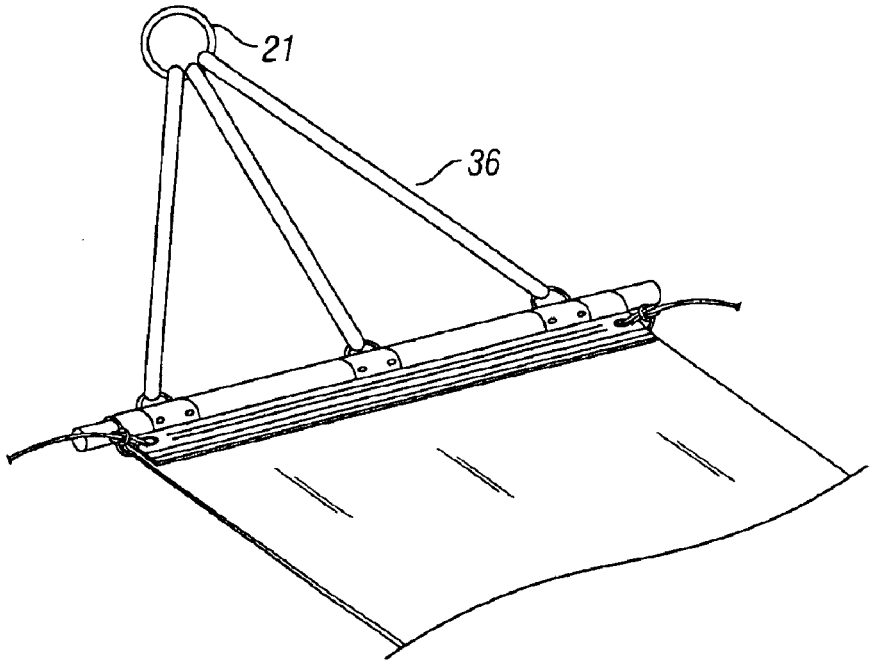
FIG. 6 is a perspective view of the water-swung hammock of FIG. 1, including swingable sheet, swingable suspension, extensions and means for stretching and securing the shape of the swingable sheet.
Figure 7:
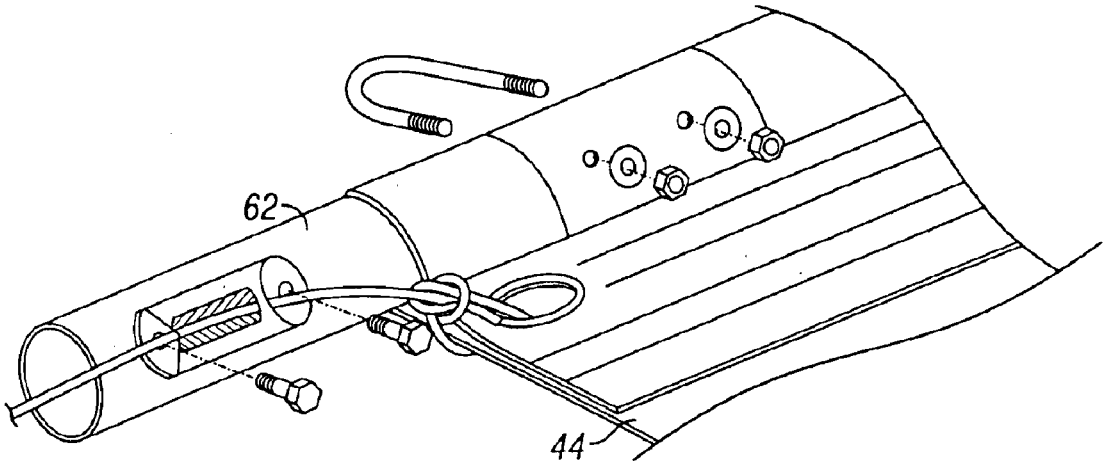
FIG. 7 is a closer perspective view of the water-swung hammock of FIG. 1, including the swingable sheet, the rigid elongated member, means for attachment from rigid elongated member to the swingable suspension, cord and means for attachment of the cord.
Figure 8:
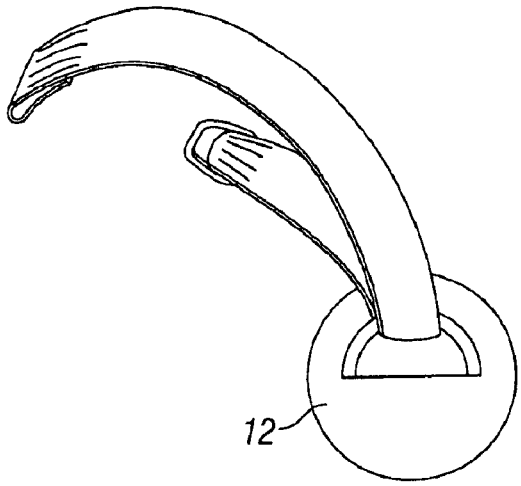
FIG. 8 is a perspective view of the water-swung hammock of FIG. 1, including the attachment member affixed to the floatable body and means for attachment from the floatable body to the leg support members.

As shown in FIG. 5, swingable sheet 44 may include a body supporting portion having means, such as the folded over sections illustrated in FIG. 5, for receiving a pair of rigid elongated members 62 at opposite ends. The elongated members may include means for adjustable attachment with corners of the body supporting portion to sustain an open shape. The elongated members may also include means for attachment to secure swingable suspension 56 including the three extensions 36 coupled to outermost points of swingable sheet 44.

In the particular embodiment illustrated in FIG. 1, water-swinging pendular assembly 59 may include a pair of adjustable cords having means for attachment at opposite ends thereof. The first ends of assembly 59 may detachably engage hooks 29 at opposite ends of main body frame 34. The second ends may be secured to ring 21 at opposite ends of the swingable suspension. Staging platform 16 may include a plurality of body supporting panels having means for attachment such as the elongated rods shown in FIG. 10 secured perpendicular to the mid-section of main body frame 34.

Although only an exemplary embodiment of the invention has been described in detail above, those skilled in the art will readily appreciate that many modifications are possible without materially departing from the scope of the present invention.

One such alternative embodiment may include a floatable body means adapted to support a swingable sheet horizontally associated to the floatable body means and including means for attachment adapted to support a user and water-swinging pendular means associated with the floatable body means and adapted to receive water movement for motive power for the water-swung hammock.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A water-swung hammock comprising:

a floatable body for supporting a main body frame including at least one leg support for securing said main body frame to said floatable body;

a staging platform being coupled to said main body frame and capable of supporting a user;

a swingable sheet for supporting the user and including a support for swingable suspension of said swingable sheet relative to said main body frame; and a water-swinging pendular assembly coupled to said main body frame for receiving water movement and thereby imparting motive power to said swingable sheet of said water-swung hammock.

2. The water-swung hammock according to claim 1, wherein said floatable body includes at least one hollow support member having an inner periphery and an outer periphery, said outer periphery includes attachment members for attachment of said main body frame to said floatable body, said inner periphery includes a space therewithin, said floatable body further includes an inflation assembly for inflating said hollow support member for thereby enabling floatation of said water-swung hammock on a body of water.

3. The water-swung hammock according to claim 1, wherein said main body frame includes a plurality of elongated members, formed members and extension members, said formed members coupling said elongated and extension members to form said main body frame.

4. The water-swung hammock according to claim 2, wherein said leg support includes a plurality of elongated members attached to said main body frame, said elongated members are positioned laterally on said outer periphery of said hollow support members and latched to said attachment members.

5. The water-swung hammock according to claim 1, wherein said swingable sheet is coupled to a pair of rigid elongated members at respective opposite ends thereof, said elongated members are adjustably attachable with said swingable sheet to maintain said swingable sheet in an open shape.

6. The water-swung hammock according to claim 1, wherein said water-swinging pendular assembly includes a pair of adjustable cords attachable at first ends thereof to said main body frame and at second ends thereof to said swingable sheet.

7. The water-swung hammock according to claim 1, wherein said staging platform includes a plurality of body supporting panels and is secured generally perpendicular to a mid-section of said main body frame.

8. The water-swung hammock according to claim 1, wherein said main body frame is formed of a one-piece structure.

9. The water-swung hammock according to claim 1, wherein said floatable body includes at least one support member enabling floatation of said water-swung hammock on a body of water.

10. A water-swung hammock comprising:

a floatable body for supporting a main body frame including a support for securing said main body frame to said floatable body;

a staging platform coupled to said main body frame;

a swingable sheet for supporting a user, said swingable sheet being pivotally suspended relative to said main body frame; and a pendular assembly coupled to said main body frame and said swingable sheet for receiving water movement and thereby imparting motive power to said swingable sheet.

11. The water-swung hammock according to claim 10, wherein said floatable body includes at least one hollow support member having an inner periphery and an outer periphery, said outer periphery includes attachment members for attachment of said main body frame to said floatable body, said inner periphery includes a space therewithin, said floatable body further includes an inflation assembly for inflating said hollow support member for thereby enabling floatation of said water-swung hammock on a body of water.

12. The water-swung hammock according to claim 10, wherein said main body frame includes a plurality of elongated members, formed members and extension members, said formed members coupling said elongated and extension members to form said main body frame.

13. The water-swung hammock according to claim 10, wherein said main body frame is formed of a one-piece structure.

14. The water-swung hammock according to claim 11, wherein said support includes a plurality of elongated members attached to said main body frame, said elongated members are positioned laterally on said outer periphery of said hollow support members and latched to said attachment members.

15. The water-swung hammock according to claim 10, wherein said swingable sheet is coupled to a pair of rigid elongated members at respective opposite ends thereof, said elongated members are adjustably attachable with said swingable sheet to maintain said swingable sheet in an open shape.

16. The water-swung hammock according to claim 10, wherein said pendular assembly includes at least one adjustable cord attachable at a first end thereof to said main body frame and at a second end thereof to said swingable sheet.

17. The water-swung hammock according to claim 10, wherein said staging platform includes a plurality of body supporting panels and is secured generally perpendicular to a mid-section of said main body frame.

18. The water-swung hammock according to claim 10, further comprising a seating area shaped by opposing spreader bars.

19. A water-swung hammnock comprising:

a floatable body including a main body frame;

a staging platform coupled to said main body frame;

a swingable sheet for supporting a user, said swingable sheet being pivotally suspended relative to said main body frame; and a pendular assembly coupled to said main body frame and said swingable sheet for receiving water movement and thereby imparting motive power to said swingable sheet, without imparting motive power to said staging platform.

20. The water-swung hammock according to claim 19, wherein said floatable body includes one of a circular, rectangular and oval cross-section.

* * * * *